United States Patent [19]

Chaudhari et al.

[11] Patent Number: 4,515,650

[45] Date of Patent: May 7, 1985

[54] METHOD FOR PRODUCING LARGE GRAINED SEMICONDUCTOR RIBBONS

[75] Inventors: Praveen Chaudhari, Briarcliff Manor, N.Y.; René Müller, Fislisbach, Switzerland

[73] Assignee: International Business Machines Corporation, Armonk, N.Y.

[21] Appl. No.: 336,486

[22] Filed: Dec. 31, 1981

Related U.S. Application Data

[63] Continuation of Ser. No. 150,257, May 15, 1980, abandoned.

[51] Int. Cl.[3] ..... C30B 19/00

[52] U.S. Cl. ..... 156/622; 156/DIG. 97

[58] Field of Search ..... 156/DIG. 88, DIG. 64, 156/DIG. 67, DIG. 97, 608, 622; 427/431, 86; 148/1.5

[56] References Cited

U.S. PATENT DOCUMENTS

| | | | |
|---|---|---|---|
| 4,108,714 | 8/1978 | Keller et al. | 156/608 |
| 4,309,239 | 1/1982 | Hvgvette | 156/601 |
| 4,323,419 | 4/1982 | Wakefield | 156/622 |

FOREIGN PATENT DOCUMENTS

| | | |
|---|---|---|
| 54-72954 | 6/1979 | Japan . |
| 109227 | 8/1980 | Japan . |

*Primary Examiner*—Hiram H. Bernstein

*Attorney, Agent, or Firm*—Yen S. Yee; Jackson E. Stanland

[57] ABSTRACT

The present invention provides a method for fabricating large grain semiconductor ribbons suitable for use in solar cells. A molten semiconductor material is discharged onto a rotating cylindrical surface which is rotating with linear velocity of not greater than 36 m/sec.

7 Claims, 2 Drawing Figures

METHOD FOR PRODUCING LARGE GRAINED SEMICONDUCTOR RIBBONS

This is a continuation of application Ser. No. 150,257 filed May 15, 1980, now abandoned.

DESCRIPTION

1. Technical Field

This invention relates to the manufacture of large grain semiconductor ribbons suitable for solar cell applications.

2. Background Art

Dropwise deposition of a semiconductor liquid into a contoured mold has been employed to generate homogenous bodies. One such patent teaching this technique is U.S. Pat. No. 3,367,394 by M. Roder et al. J. Meuleman et al in U.S. Pat. No. 4,124,411 employs a dropwise technique to form on a substrate a layer of a semiconductor material. While the later technique allows the production of layers of semiconductors suitable for solar cells the generation of these layers is slow and an appropriate substrate must be prepared.

It has been reported that equipment classically employed to produce amorphous alloy ribbons can be used to generate polycrystalline ribbons of silicon which can be employed for solar cells. The crystalline silicon ribbons so produced are deposited in an evacuated chamber and have a small grain size. N. Tsuya and K. I. Arai, report in Solid State Physics (in Japanese) 13, 237 (1978), grain size of 2~3 microns. They have reported the results for the same operating conditions in Jpn. J. Applied Phys., 18, 207 (1979), where as an average grain size of several microns.

These small grains are substantially smaller than those which should be employed to maintain a reasonable efficiency in any resulting solar cell. In order to obtain an efficiency of approximately 10% it would be required that the grain size be increased by an order of magnitude to approximately 10 to 30 microns.

DISCLOSURE OF INVENTION

It is an object of the invention to establish a method for producing a semiconductor ribbon of suitable quality for solar cells.

Another object of the invention is to establish a method for production of semiconductor ribbons with an average grain size of about 20 microns and greater.

Still another object of this invention is to provide a method for producing semiconductor ribbons with a coherent oxide.

Yet another object of the invention is to provide a method for the production of substantial volumes of silicon ribbon.

These and other objects and advantages of the invention will become apparent from the following description, accompanying drawings, and appended claims in which various novel features of the invention are more particularly set forth.

The present invention provides a method for fabricating large grain semiconductor ribbons. A molten semiconductor material is discharged onto a rotating cylindrical surface which is rotating with a linear velocity of not greater than 36 m/sec.

Further, the invention provides a method of fabricating a ribbon of semiconductor material wherein the molten material is discharged on the surface of a cylinder rotating at a linear velocity between about 8 m/sec and 36 m/sec.

BEST MODE FOR CARRYING OUT THE INVENTION

Figure 1:
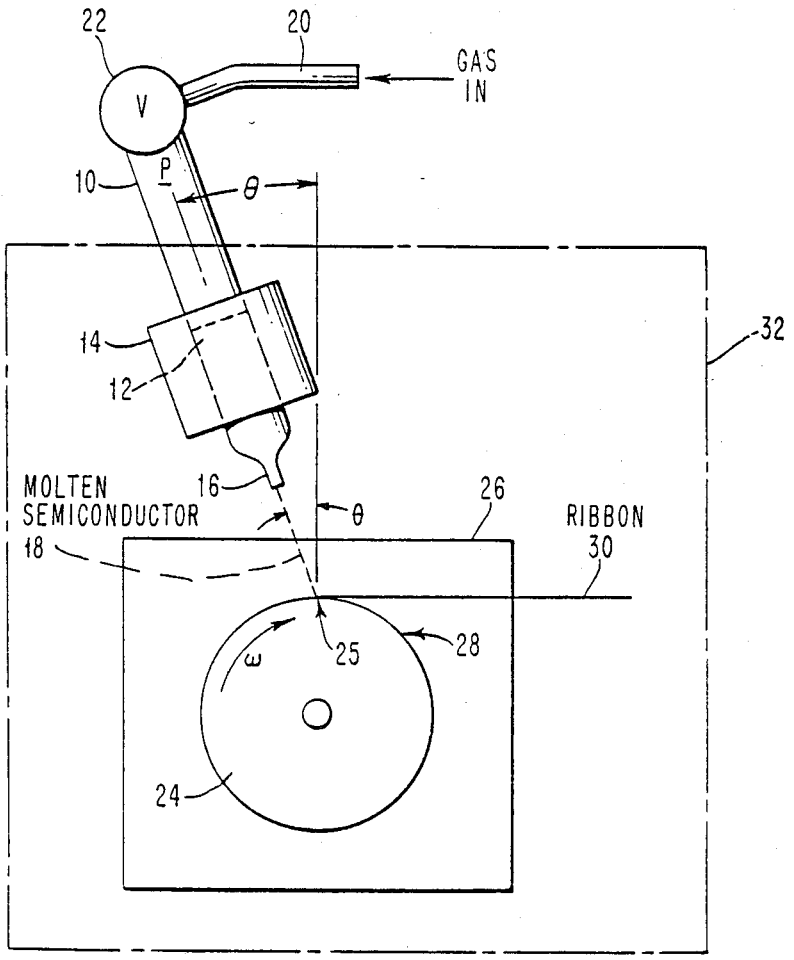
FIG. 1 is a schematic representation of a ribbon caster suitable for practicing the invention.

A device suitable for the implementation of this invention is illustrated in FIG. 1. A tube 10 is employed for containing a molten semiconductor material 12. The semiconductor material 12 is maintained molten by a furnace 14 which surrounds the tube 10. The tube 10 has a nozzle 16 which is employed to direct a molten stream 18 of the semiconductor material 12. Examples of such semiconductor materials are Si, Ge, and Ga-As. A gas supply tube 20 feeds gas into the tube 10 via a regulating valve 22. The regulating valve 22 controls pressure in the tube 10 above the molten semiconductor material 12. This pressure serves to discharge the molten semiconductor material 12 through the nozzle 16 and forms the stream 18. The stream 18 impinges on a rotating wheel 24. Preferably the stream 18 impacts the wheel 24 at an angle $\theta$ such that there is a component of the stream direction which is in the direction of a tangent to the rotating wheel 24 at the point of contact 25. This component should be in the direction of the rotation. The wheel 24 is driven from a power drive 26 such as a motor. The wheel 24 should be a conducting material. Stainless steel, as well as copper, have been found to be satisfactory materials. During operation the stream 18 impinges on the rotating cylindrical surface 28 thereby generating a semiconductor ribbon 30.

In carrying the invention into practice a gas is supplied to the gas supply tube 20 and pressure p in the tube 10 is maintained above the semiconductor material by the regulating valve 22. This pressure p controls the discharge of the stream 18 from the nozzle 16. The stream 18 impinges upon the wheel 24 which is rotating as illustrated.

It has been found that when the ribbon is generated in air it is preferred to use a copper wheel 24. When a copper wheel is used it is advisable to gold plate the cylindrical surface of the wheel 28 to avoid oxidation of the copper during operation.

It has also been found that, when the injection pressure p in the insulating tube is maintained at or above 8 psig (psig being defined as pounds per square inch gauge where reference pressure is the gas pressure at the wheel) and the nozzle 18 has an opening of a nominal diameter of 1 mm, a satisfactory ribbon 30 can be maintained when the linear velocity of the cylindrical surface 28 is in excess of 8 m/sec. It is furthermore preferred that the angle of incidence $\theta$ of the stream 18 with respect to the cylindrical surface 28 be from about 9° to 15° when defined with respect to an extended diameter passing through the point of contact 25.

In addition to the lower limits on the linear velocity of the cylindrical surface 28 which is required to maintain a semiconductor ribbon 30, the cylindrical surface 28 may not obtain velocities greater than 36 m/sec without substantially reducing the ultimate average grain size of the resulting semiconductor ribbon 30.

Figure 2:
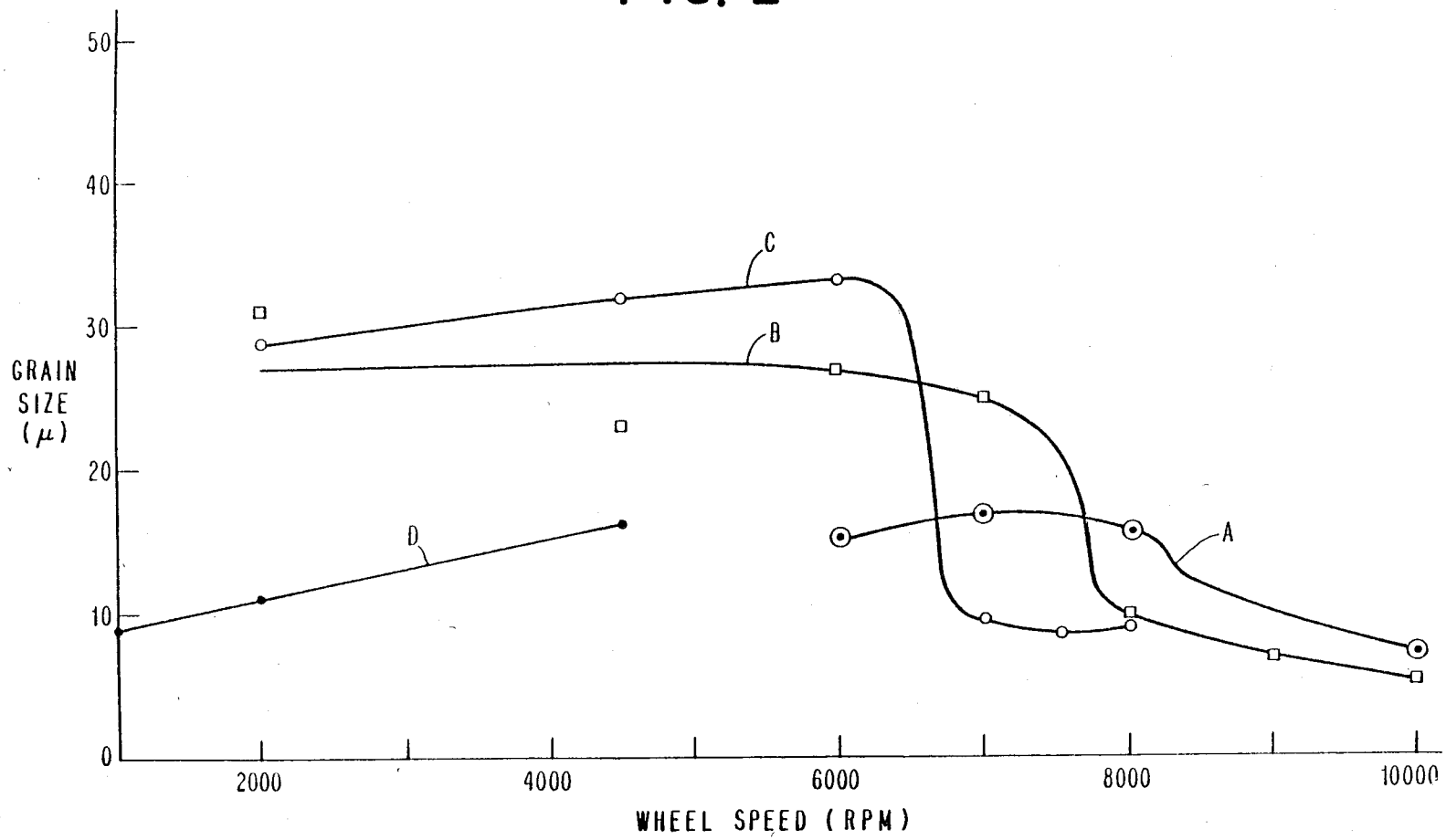
FIG. 2 is a graphical depiction of the effect of wheel speed and injection pressure on grain size.

FIG. 2 offers a graphical representation of the effect of wheel speed on the average grain size. For these curves semiconductor materials were generated on a copper wheel, having a diameter of 7.6 cm. Curves A, B and C are for silicon where the molten silicon is heated to about 1500° C. and the gas injection pressure p was maintained at respectively 4 psig, 8 psig, and 15 psig for a nozzle having a nominal opening 1 mm in diameter. As the pressure is increased the ribbon becomes thinner and above about 15 psig the ribbon becomes discontinuous and forms flakes. It is apparent that as one increases the pressure there is an increase in the ultimate grain size which can be obtained.

Wheel speed has a marked effect on the ultimate grain size. It can be seen that at rpms greater than about 9000 a surface speed of or about 36 m/sec the grain size has dropped to the neighborhood of slightly less than 10 microns and as the velocity of the wheel is further increased the change in grain size is not substantially effected. This decrease in grain size occurs for all pressures studied. The drop is sharpest for curves B and C.

It is felt that one plausible explanation for the relatively large grain sizes produced at the higher rotational speed of the wheel 24 when compared to the earlier reported work of N. Tsuya and K. I. Arai is that in present study a smaller wheel 24 was employed. To obtain the same surface velocity with a smaller wheel requires a greater rotational speed. Greater rotational speed will result in a greater centrifugal force acting on the ribbon. The centrifugal force may act to reduce contact with the wheel and thereby lessen the cooling effect of the wheel and thereby reduce the cooling rate of the ribbon. A slower cooling rate may account for the larger grain size.

It is also apparent that once the velocity has been slowed sufficiently to produce a large grain size further reduction in the wheel velocity does not substantially change the grain size. The data used to generate these curves of FIG. 2 is contained in Table I.

The velocity of the wheel is presented both in terms of rotational speed (rpm) and the linear velocity (m/sec) of the cylindrical surface 28. The pressures are given in terms of the gas ejection pressure for the resulting semiconductor stream 18. It was found that changing the orifice diameter from 0.5 mm to 1.5 mm did not noticeably affect the grain size of the resulting ribbons. Furthermore, it should be appreciated that the linear velocity of the surface of the wheel as well as ejection pressure are the appropriate parameters for the control of relative grain size of the resulting ribbon. These parameters can be maintained independent of the geometry of the equipment employed.

Curve D of FIG. 2 illustrates the effect of velocity on the grain size of germanium semiconductor ribbons. These ribbons were generated from molten germanium which was heated to about 1000° C. and ejected at a pressure of 15 psig through a nozzle having a nominal diameter of 1 mm. As can be seen by comparing curves C and D the germanium data as is the case for the silicon data show little dependence of size or speed at low speeds. The tabular data used to generate curve D has been incorporated into Table I.

TABLE I

Effect of Wheel Velocity and Injection Pressure on Grain Size

| Material | Wheel Velocity RPM | Surface Speed in m/sec | Injection Pressure (psig) | Average Grain Size (Microns) |
|---|---|---|---|---|
| Silicon | 6,000 | 24 | 4 | 14.9 |

TABLE I-continued

Effect of Wheel Velocity and Injection Pressure on Grain Size

| Material | Wheel Velocity RPM | Surface Speed in m/sec | Injection Pressure (psig) | Average Grain Size (Microns) |
|---|---|---|---|---|
| | 7,000 | 28 | 4 | 17.0 |
| | 8,000 | 32 | 4 | 15.4 |
| | 10,000 | 40 | 4 | 7.0 |
| Silicon | 2,000 | 8 | 8 | 31.2 |
| | 4,500 | 18 | 8 | 23.1 |
| | 6,000 | 24 | 8 | 26.8 |
| | 7,000 | 28 | 8 | 24.8 |
| | 8,000 | 32 | 8 | 9.75 |
| | 9,000 | 36 | 8 | 7.0 |
| | 10,000 | 40 | 8 | 5.0 |
| Silicon | 2,000 | 8 | 15 | 28.9 |
| | 4,500 | 18 | 15 | 31.7 |
| | 6,000 | 24 | 15 | 33.1 |
| | 7,000 | 28 | 15 | 9.7 |
| | 7,500 | 30 | 15 | 8.7 |
| | 8,000 | 32 | 15 | 9.2 |
| Germanium | 1,000 | 4 | 15 | 9.0 |
| | 2,000 | 8 | 15 | 11.0 |
| | 4,500 | 18 | 15 | 16.3 |

Both germanium and silicon form oxides on the surface of the resulting ribbons when the ribbons are generated in an atmosphere of air. These oxides are sufficient to provide an intermediate layer between the silicon and a metal deposited thereon. The resulting metal silicon junctions form Schottky barriers.

The oxide may be prevented by generating the ribbon under a protective atmosphere. Argon and helium have been found to be effective atmospheres in which to generate the ribbons. In the event that a protective atmosphere is sought the wheel 28 and nozzles 16 should be placed in a chamber 32 as illustrated by the broken line in FIG. 1. This chamber will allow the atmosphere to be controlled.

Industrial Applicability

The present invention will be of use in the semiconductor industry and in particular in solar cell production.

While the present invention has been illustrated and described in terms of preferred modes, it is to be understood that these modes are by way of illustration and not limitation and the right is reserved to all changes and modification coming within the scope of the invention as defined in the appended claims.

Having described the invention, what I claim as new and desire to secure by Letters Patent is:

1. In a method for fabricating a ribbon of semiconductor material wherein the semiconductor material in a molten state is discharged as a stream onto the cylindrical surface of only one rotating cylinder comprised of conducting material to form said ribbon by ribbon casting from said cylindrical surface, the improvement comprising:

discharging said material at an angle of incidence with respect to said cylindrical surface to a point of contact on said surface such that there is a component of said stream in the direction of a tangent to said cylinder at said surface in the direction of rotation thereof, and rotating said cylinder at a surface linear velocity in the range of about 8 meters/sec to about 36 meters/sec to obtain crystalline semiconductor ribbon having an average grain size of about 20 microns and greater.

2. The method of claim 1 wherein said linear velocity is not greater than 36 meters/sec.

3. The method of claim 2 wherein said angle of incidence of said molten stream with respect to said cylindrical surface is in the range from about 9° to about 15° with respect to an extended diameter passing through said point of contact.

4. The method of claim 1, wherein said angle of incidence is in the range of from about 9° to about 15°, and said semiconductor material is discharged at an injection pressure in the range from about 4 psig to about 15 psig.

5. The method of claim 1, wherein said semiconductor material is selected from the group consisting of silicon and germanium.

6. The method of claim 1, wherein said conducting material of said rotating cylinder is selected from the group consisting of copper and stainless steel.

7. The method of claim 6, wherein said rotating cylinder comprises copper with goldplate on its cylindrical surface.

* * * * *